US008096368B1

(12) United States Patent
Rider

(10) Patent No.: US 8,096,368 B1
(45) Date of Patent: Jan. 17, 2012

(54) FENCE POST INSTALLATION AND ANCHORING SYSTEM

(76) Inventor: Stephen B. Rider, Gravette, AR (US)

( * ) Notice: Subject to any disclaimer, the term of this patent is extended or adjusted under 35 U.S.C. 154(b) by 127 days.

(21) Appl. No.: 12/687,247

(22) Filed: Jan. 14, 2010

(51) Int. Cl.
*E21B 1/38* (2006.01)

(52) U.S. Cl. ..... 173/1; 173/90; 173/91

(58) Field of Classification Search ..... 173/90, 173/91, 118, 102, 126; 248/545; 405/244
See application file for complete search history.

(56) References Cited

U.S. PATENT DOCUMENTS 2,086,213 A * 7/1937 Collord ..... 405/244
2,282,049 A * 5/1942 Haggart, Jr. ..... 405/244
2,998,087 A 8/1961 Iddings
3,358,967 A 12/1967 Harmon
4,494,612 A 1/1985 Bell
4,653,245 A 3/1987 Webb
4,682,761 A 7/1987 Hanneken
4,803,812 A 2/1989 Alexander, Sr.
5,165,663 A 11/1992 Wells
6,973,822 B1 * 12/2005 Sawyers ..... 73/82

* cited by examiner

*Primary Examiner* — Rinaldi Rada
*Assistant Examiner* — Nathaniel Chukwurah
(74) *Attorney, Agent, or Firm* — Montgomery Patent & Design, LLC; Robert C. Montgomery; Joseph T. Yaksich

(57) ABSTRACT

A hand-driven receiving bracket for galvanized or steel pipe used with yard fences, gateposts, pet pens, and the like comprises a round galvanized pipe and three (3) downwardly directed triangular steel plates. The bracket is then driven into the ground such that the top of the pipe is flush with the ground surface. After driving, the receiver bracket is ready for fence posts, gateposts, and other ground style devices. A plate device that sits atop the bracket and can be driven with a large sledgehammer provides a large flat surface that is suitable for impact and spreads such impact over the entire bracket, thus preventing damage. Alternately, a sliding hammer that slides upon a tall steel pipe which connects to the top of the bracket is used to drive the bracket into the ground and comprises a twist lock mechanism that engages the bracket and spreads the impact to prevent damage. When driven flush, it also is removed and replaced with a permanent fence or gateposts.

16 Claims, 8 Drawing Sheets

FENCE POST INSTALLATION AND ANCHORING SYSTEM

RELATED APPLICATIONS

The present invention was first described in a notarized Official Record of Invention on Feb. 16, 2009, that is on file at the offices of Montgomery Patent and Design, LLC, the entire disclosures of which are incorporated herein by reference.

FIELD OF THE INVENTION

The present invention relates generally to fence posts and fence post installation systems, and in particular, to a fence post installation and anchoring system for yard fences, gate posts, pet pens, and the like.

BACKGROUND OF THE INVENTION

Posts are a common feature of many favored structural assemblies in properties through the world. Structural posts constitute integral features of structures such as fences, gateposts, pet pens, trellises, and the like. The stability and long term usefulness of such items depends heavily upon the foundation used to drive vertical members or posts used with the item. As such, the stability of the installation of such members is of critical importance and great care is taken to ensure that such posts are adequately secured.

A problem commonly encountered in the installation of posts such as fence posts is that any method which allows a post to be easily inserted into the ground results in unstable conditions. For example, the digging of an oversized hole means that a post will not have anything to keep it firmly upright once placed in the hole. This is solved by backfilling the hole with gravel, concrete, or the like. However, such methods can be inefficient, time consuming, labor intensive, or expensive.

Various attempts have been made to provide devices which aid in the installation or removal of fence posts. Examples of these attempts can be seen by reference to several U.S. patents. U.S. Pat. No. 2,998,087, issued in the name of Iddings, describes a fence post driver. The Iddings device helps a user to deliver downwards blows to thin items such as posts.

U.S. Pat. No. 4,803,812, issued in the name of Alexander, Sr., describes a post ground anchor and method. The Alexander device is an anchor with a threaded spike to allow a user to engage the spike with a ground surface.

U.S. Pat. No. 4,682,761, issued in the name of Hanneken, describes a fence post bracing system. The Hanneken system includes a plurality of posts with lower ends engaged in the ground and slidably adjustable horizontal portions connecting the lower ends which allow for the adjustable placement of the upper ends.

While these devices fulfill their respective, particular objectives, each of these references suffer from one (1) or more of the aforementioned disadvantages. Many such devices do not provide a simple, easy means of driving a ground anchor. Also, many such devices do not integrate ground anchors and driving means in a manner which allows the driving means to snugly and precisely engage the ground anchors. In addition, many such devices do not provide a sufficiently even, flat distribution of force during installation. Furthermore, many such devices do not aid in both the installation and removal of post anchors. Finally, many such devices do not provide an easily adjustable and reusable method for aiding in post installation. Accordingly, there exists a need for a fence post installation and anchoring system without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a device and system which allow a user to install, anchor, remove, and adjust fence posts or similar items in a manner which is simple, easy, adjustable, secure, and adaptable. Thus, the object of the present invention is to solve the aforementioned disadvantages and provide for this need.

To achieve the above objectives, it is an object of the present invention to comprise an anchor device, a post receiving bracket, a driving device, and a means for a post to be installed. In a preferred embodiment, the system is fabricated of a metallic substance, such as steel, for strength with an anti-corrosion coating such as galvanizing or paint.

Another object of the present invention is to comprise the anchor device of a cylindrical member and a pointed edge at a distal end to assist in the driving of the anchor device. The cylindrical member provides a means which can support a post for yard fences, gate posts, and the like. In a preferred embodiment, the cylindrical member is a solid piece of steel with an outside diameter sized adequately to support the system.

Yet still another object of the present invention is to further comprise the anchoring device of a receiving tube with an inside diameter slightly larger than that of a post to be installed. The tube is situated directly above the cylindrical member and has an open upper portion to receive the post. The tube comprises inside and bottom walls for a round post to rest upon, utilizing frictional forces such as adhesive, fasteners, or the like to secure the post.

Yet still another object of the present invention is to comprise the post receiving bracket of a cylinder with adequate diameter and thickness to accommodate posts of various size, shape, and function. The bracket is integrally affixed to the anchor device and receiving tube and encircles the outside perimeter of the receiving tube. The bracket is further secured by means of a plurality of gussets spanned along the centerline of the cylindrical member.

In a preferred embodiment, the receiving bracket further comprises four threaded bores positioned in a rectangular array around the receiving tube. The bores receive threaded screws which are utilized to install "L" brackets. The brackets support four (4) metallic barriers which comprise four (4) inside walls oriented in a manner which would provide a box-like structure with an open upper wall to receive and support a rectangular post.

Yet still another object of the present invention is to further comprise the post receiving bracket of two (2) receiving apertures disposed through the thickness of the bracket and shaped to receive and releasably lock with a pair of "T"-shaped pins. The apertures provide a means for the driving device to releasably lock with the anchor device, thus providing a means for driving the anchor device into the ground.

Yet still another object of the present invention is to comprise the driving device of a long cylinder containing two (2) contact arms positioned relatively in the middle of the driving device. A bottom side of the driving device comprises an integral contact member shaped similar to the post receiving bracket and aligned centrally with the driving device cylinder.

Yet still another object of the present invention is to further comprise the contact member of a pair of integral "T"-shaped pins designed to cooperate with the post receiving bracket. A user may releasably lock the driving device and anchor device by inserting the pins into the larger portion of the apertures and rotating the driving device to slide into the smaller portion of the apertures.

Yet still another object of the present invention is to comprise the hammer device of a heavy metallic cylindrical tube with two (2) handles. The hammer device has a diameter proportionally larger than the driving device, enabling the driving device to be slidably received within the hammer device. The handles may be gripped by a user to move the hammer in a quick downward motion in order to come in contact with the contact arms, creating an even downward force on the driving device to urge the anchor into the ground.

Yet still another object of the present invention is to provide a method of utilizing the device that provides a unique means of removably attaching a fence post anchor to a driving device, easily installing a bracket by means of the anchor using an associated hammer device, easily detaching the installation portion, and subsequently securely and removably anchoring a fence post within the fence post anchor in a quick, simple, and easy manner.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
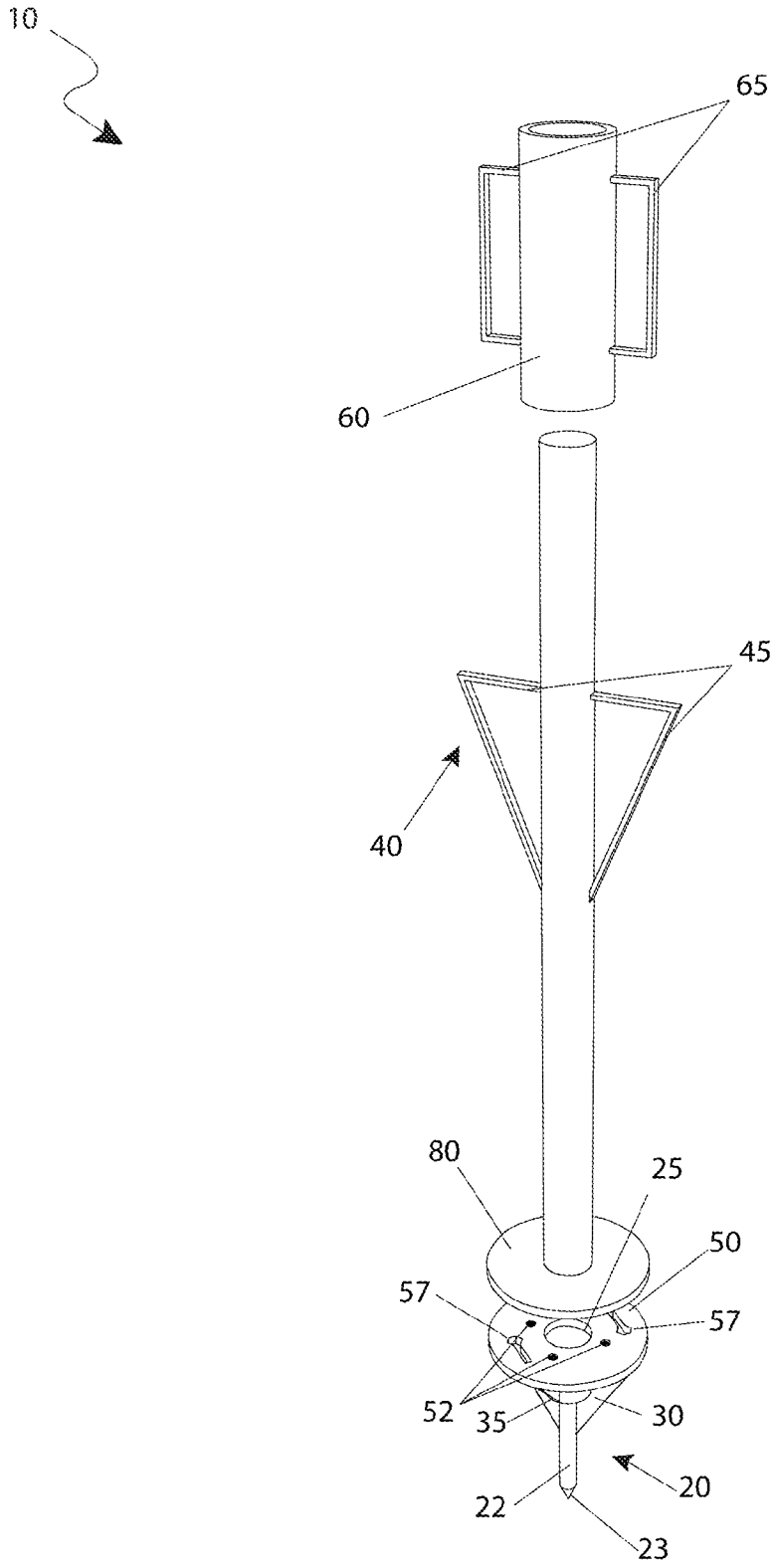
FIG. 1 is a perspective view of a fence post installation and anchoring system 10 with a hammer device 60 installably removed therefrom a driving device 40 which is installably removed therefrom an anchor device 20, according to the preferred embodiment of the present invention.

10 fence post installation and anchoring system
20 anchor device
22 cylindrical member
23 pointed edge
25 receiving tube
30 large gusset
35 small gusset
40 driving device
45 contact arm
50 post receiving bracket
52 threaded bore
53 threaded screw
55 "L" bracket
57 receiving aperture
60 hammer device
65 hammer handle
70 metallic barrier
80 contact member
87 "T"-shaped pin

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system and method that may be utilized to install yard fences, gate posts, pet pens, tubes, and/or any other barrier type means. The fence post installation and anchoring system (herein described as the "system") 10 comprises an anchor device 20, a post receiving bracket 50, a driving device 40, and a means for a cylindrical and/or rectangular post (not pictured) to be installed. The system 10 would be preferably fabricated of a metallic substance, i.e. steel, for strength with an anti-corrosion coating such as galvanizing or paint. However, it will be appreciated that the system 10 may be fabricated of other substances such as composites and/or plastics in addition to or instead of the steel.

Referring now to FIG. 1, a perspective view of the system 10 with a hammer device 60 installably removed therefrom a driving device 40 which is installably removed therefrom an anchor device 20, is disclosed according to the preferred embodiment of the present invention. The system 10 provides a means to remain securely driven into the ground via an anchor device 20. The anchor device 20 comprises a cylindrical member 22 that converges into a substantially pointed edge 23 at the distal end to assist in the driving of said anchor device 20. The distal end is envisioned to be shaped substantially like a cone with the base of the cone comprising the same diametrical size as the diameter of the shaft of the cylindrical member 22. The cylindrical member 22 is preferably a solid piece of steel with an outside diameter that is sized adequately to support the system 10, and yet require minimal driving force to install the anchor device 20 into the ground. In such a manner, the anchor device 20 provides a means which can support a post for yard fences, gate posts, pet pens, and/or any other barrier type means, which will simply be herein referred as "post" or "posts".

Integral with the anchor device 20 is a receiving tube 25 that is envisioned to comprise an inside diameter that is slightly larger than that of the post that will be installed therein. The receiving tube 25 is envisioned to be integral with the anchor device 20 that is situated directly above the cylindrical member 22 with a centerline substantially aligned or parallel therewith the centerline of said cylindrical member 22. The bottom surface of a bottom wall of the receiving tube 25 is envisioned to be permanently affixed thereto the top side surface of the cylindrical member 22. The receiving tube 25 is envisioned to comprise an inside wall that is cylindrical and a bottom wall for the round posts to rest thereupon. The upper portion of the receiving tube 25 remains open to operably receive the post. The diametrical size of the inside wall of the receiving tube 25 is sized such that the post may be installed substantially snug, utilizing frictional forces to retain said post. The post is frictionally received until the lower end of said post is in contact with the upper surface of the bottom wall of the receiving tube 25 in order to fixedly support said post within said receiving tube 25. The post can optionally be secured therein the receiving tube 25 utilizing means in combination with or instead of the frictional forces such as, but not limited to: suitable conventional adhesive, fasteners, and/or other securing means.

Figure 2:
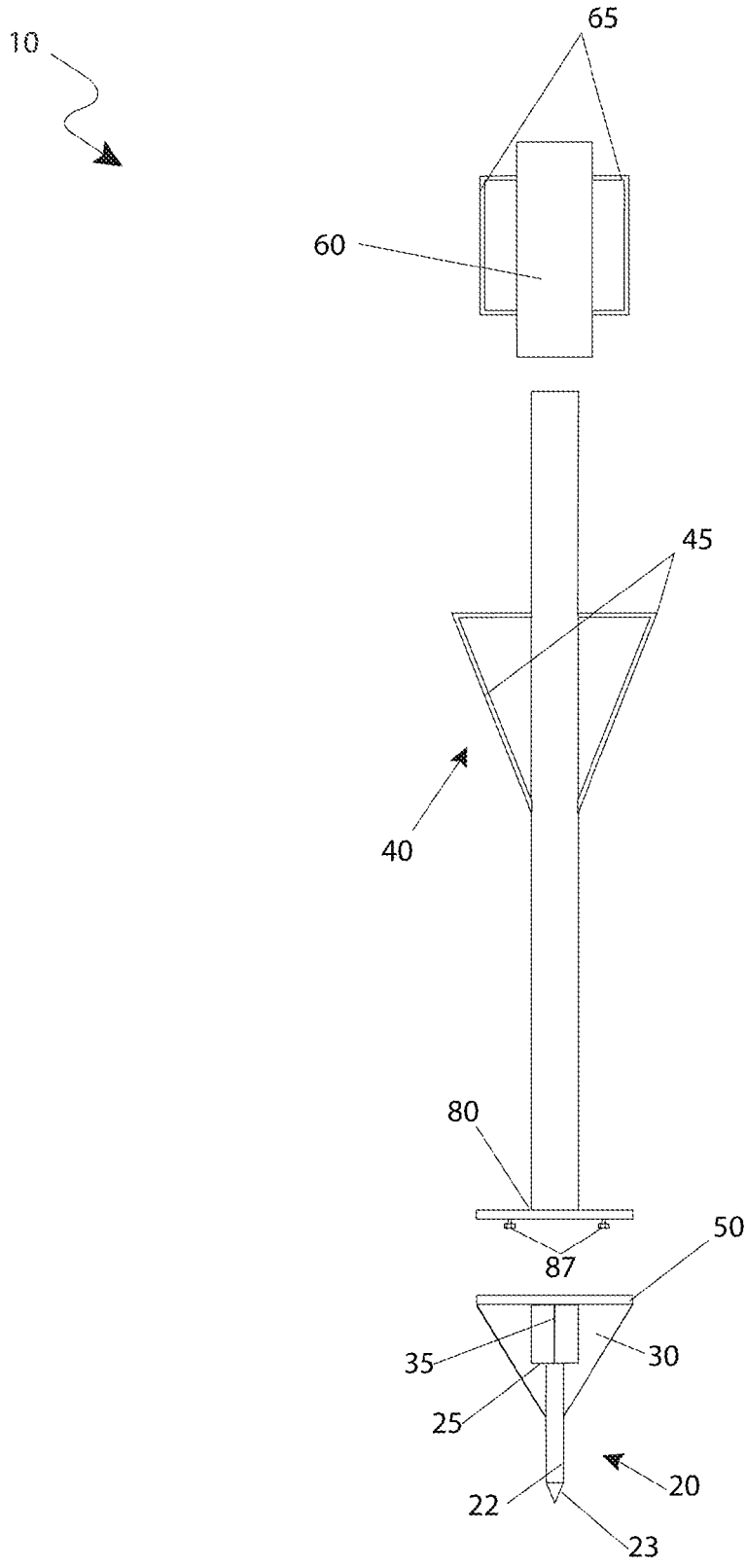
FIG. 2 is a front view of the fence post installation and anchoring system 10 with the hammer device 60 installably removed therefrom the driving device 40 which is installably removed therefrom the anchor device 20, according to the preferred embodiment of the present invention.
Figure 3:
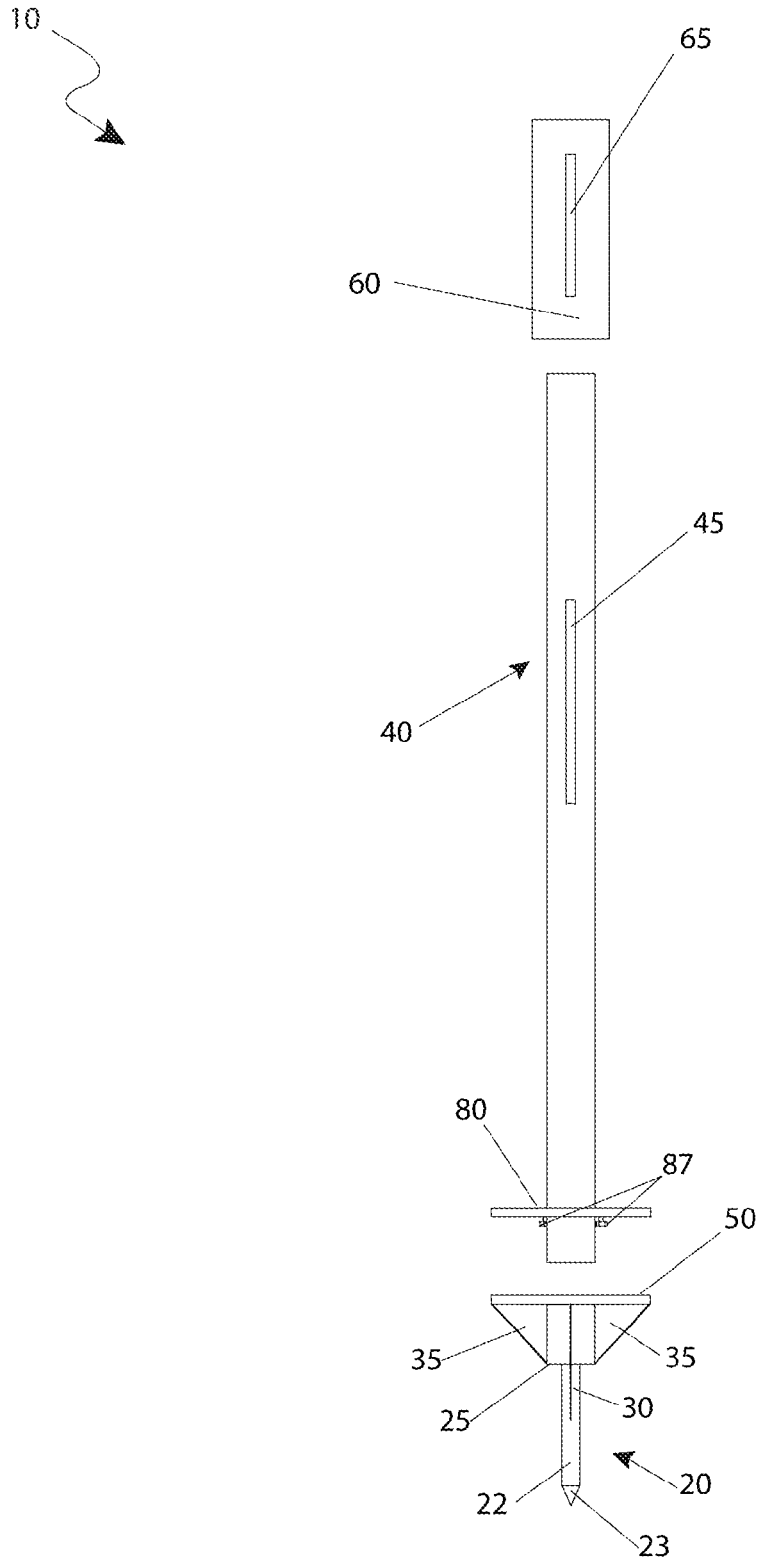
FIG. 3 is a side view of the fence post installation and anchoring system 10 with the hammer device 60 installably removed therefrom the driving device 40 which is installably removed therefrom the anchor device 20, according to the preferred embodiment of the present invention.

Referring now to FIGS. 2 and 3, various views of the system 10 with a hammer device 60 installably removed therefrom a driving device 40 which is installably removed therefrom an anchor device 20 are disclosed according to the preferred embodiment of the present invention. A post receiving bracket 50 is envisioned to be integrally affixed thereto the anchor device 20. The post receiving bracket 50 encircles the outside perimeter edge of the receiving tube 25. The post receiving bracket 50 is envisioned to take the form of a cylinder with an adequate diameter and thickness to accommodate posts of various size, shape, and function. The post receiving bracket 50 is envisioned to be integral with the anchor device 20 that is situated encircling the outside perimeter of the receiving tube 25 with a centerline substantially aligned or parallel therewith the centerline of said receiving tube 25, and consequently the cylindrical member 22. The post receiving bracket 50 is integrally affixed thereto the receiving tube 25 and further secured by means of one (1) or more gussets 30, 35 that are spanned radially equidistant along the centerline of the cylindrical member 22, and consequently the receiving tube 25. It is preferred, however not essential, that the gussets 30, 35 be introduced in a plurality of sizes to adequately secure the post receiving bracket 50 while still allowing the anchor device 20 to be driven in the ground with minimal effort. For example, the figures are depicted as to having two (2) differently sized gussets 30, 35 in which for the sake of clarity have been described as small gusset 35 and large gusset 30. In this example, the figures depict four (4) gusset 30, 35*s*: two (2) small gussets 35 and two (2) large gussets 30 that are spaced equidistantly radial, i.e. ninety degrees (90°) apart from one (1) another. It will be appreciated that the size of the gussets 30, 35, radial spacing, and amount of the gussets 30, 35 used may vary without leaving the scope of the invention. The large gussets 30 are envisioned to be secured to the bottom side surface of the post receiving bracket 50, the side surface of the receiving tube 25, and the side surface of the cylindrical member 22. The small gussets 35 are envisioned to be secured to the bottom side surface of the post receiving bracket 50 and the side surface of the receiving tube 25.

Figure 4:
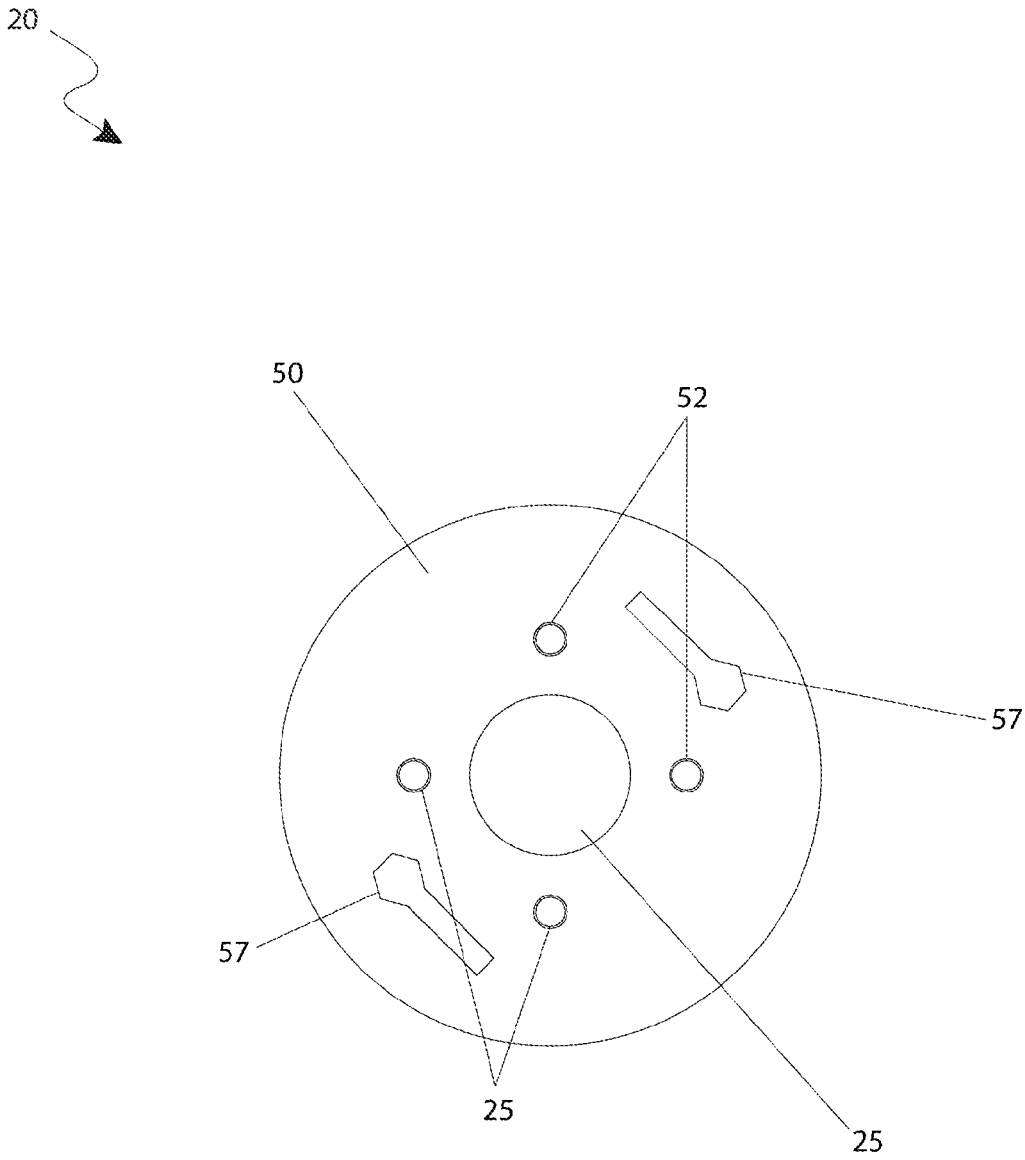
FIG. 4 is a top view of the anchor device 20, according to the preferred embodiment of the present invention.
Figure 5:
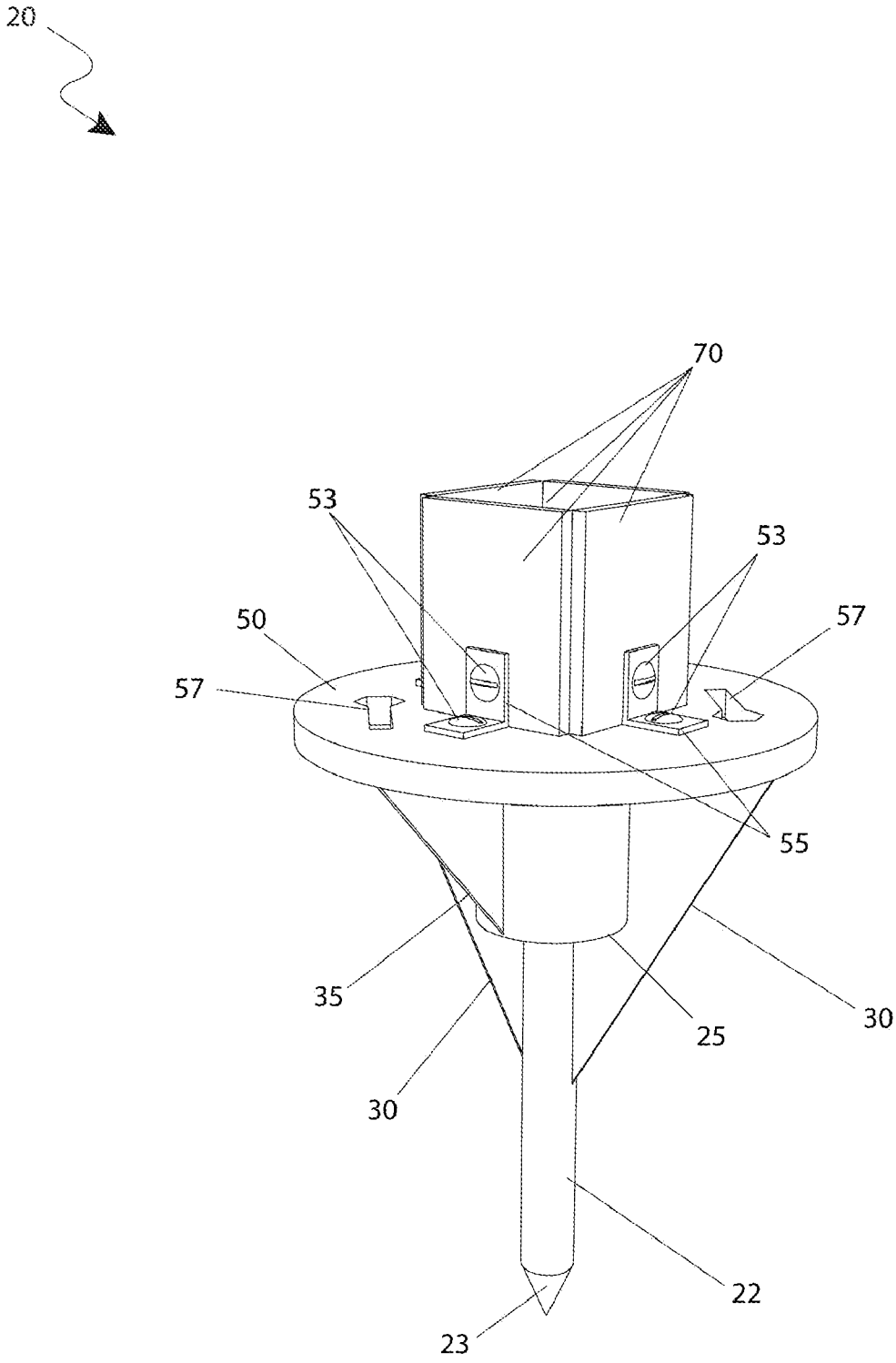
FIG. 5 is a perspective view of the anchor device 20 with four (4) metallic barriers 70 releasably installed thereon a post receiving bracket 50, according to the preferred embodiment of the present invention.

Referring now to FIGS. 4 and 5, various views of the anchor device 20 are disclosed according to the preferred embodiment of the present invention. The post receiving bracket 50 comprises four (4) threaded bores 52 that are positioned in an array relatively center thereof for receiving threaded screws 53. The threaded screws 53 are utilized to install "L" brackets 55 that may be utilized to install metallic barriers 70 for the support of a rectangular post. It is envisioned that four (4) metallic barriers 70 would be installed that will comprise four (4) inside walls oriented in a manner which would resemble a rectangle. The inside walls would be sized to be slightly larger than the outside perimeter of a rectangular post that will be installed therein. The metallic barriers 70 could optionally be installed upon successful driving of the anchor device 20 therein the ground and would be situated directly above the post receiving bracket 50, and consequently the cylindrical member 22. The metallic barrier 70 is envisioned installed in a manner which would provide a relatively box-like structure with an open upper wall to receive the rectangular posts. The dimensional size of the inside contact surfaces of the metallic barriers 70 is sized such that the rectangular post may be installed substantially snug, utilizing frictional forces to retain said post. Once installed, the rectangular post rests on the top surface of the post receiving bracket 50, directly above the receiving tube 25, and may be affixed thereto the metallic barriers 70 by means of screws 53, fasteners, adhesives, and/or other affixing means.

Figure 6:
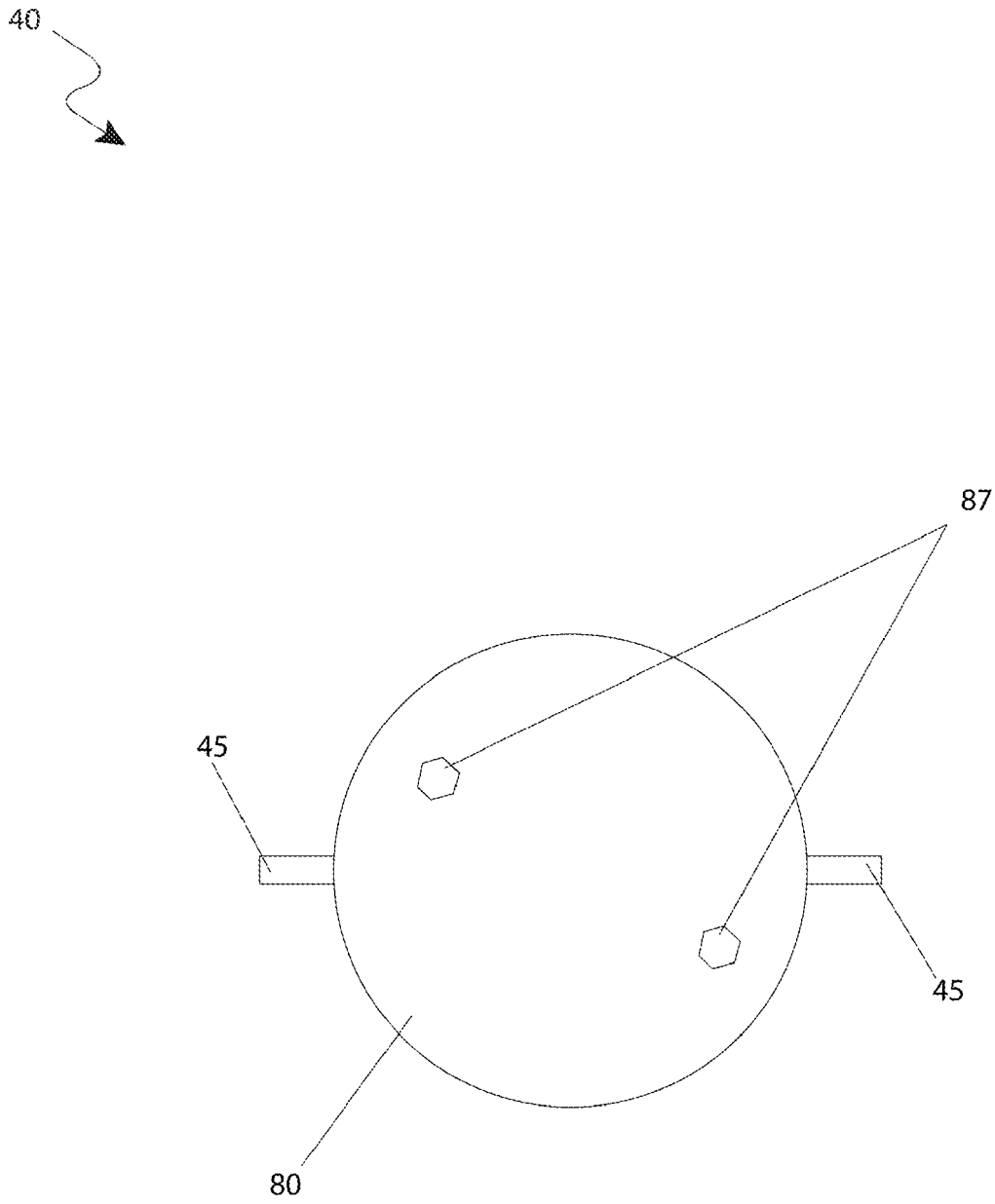
FIG. 6 is a bottom view of a driving device 40 illustrating the contact member 80, according to the preferred embodiment of the present invention.

Referring now to FIG. 6, a bottom view of the driving device 40 is herein disclosed according to the preferred embodiment of the present invention. The post receiving bracket 50 further comprises at least two (2) receiving apertures 57 strategically designed to accept "T"-shaped pins 87, which will be discussed later in greater detail. The apertures 57 are disposed therethrough the thickness of the post receiving bracket 50 shaped in order to receive and releasably lock the "T"-shaped pins 87. The apertures 57 are disposed relatively mirrored along the lateral axis of the post receiving bracket 50 oriented symmetrically. The apertures 57 are strategically sized and shaped to removably receive two (2) "T"-shaped pins 87 thereby providing a means for the driving device 40 to releasably lock therewith the anchor device 20, and consequently provide a means for said driving device 40 to drive the anchor device into the ground 20.

Figure 7:
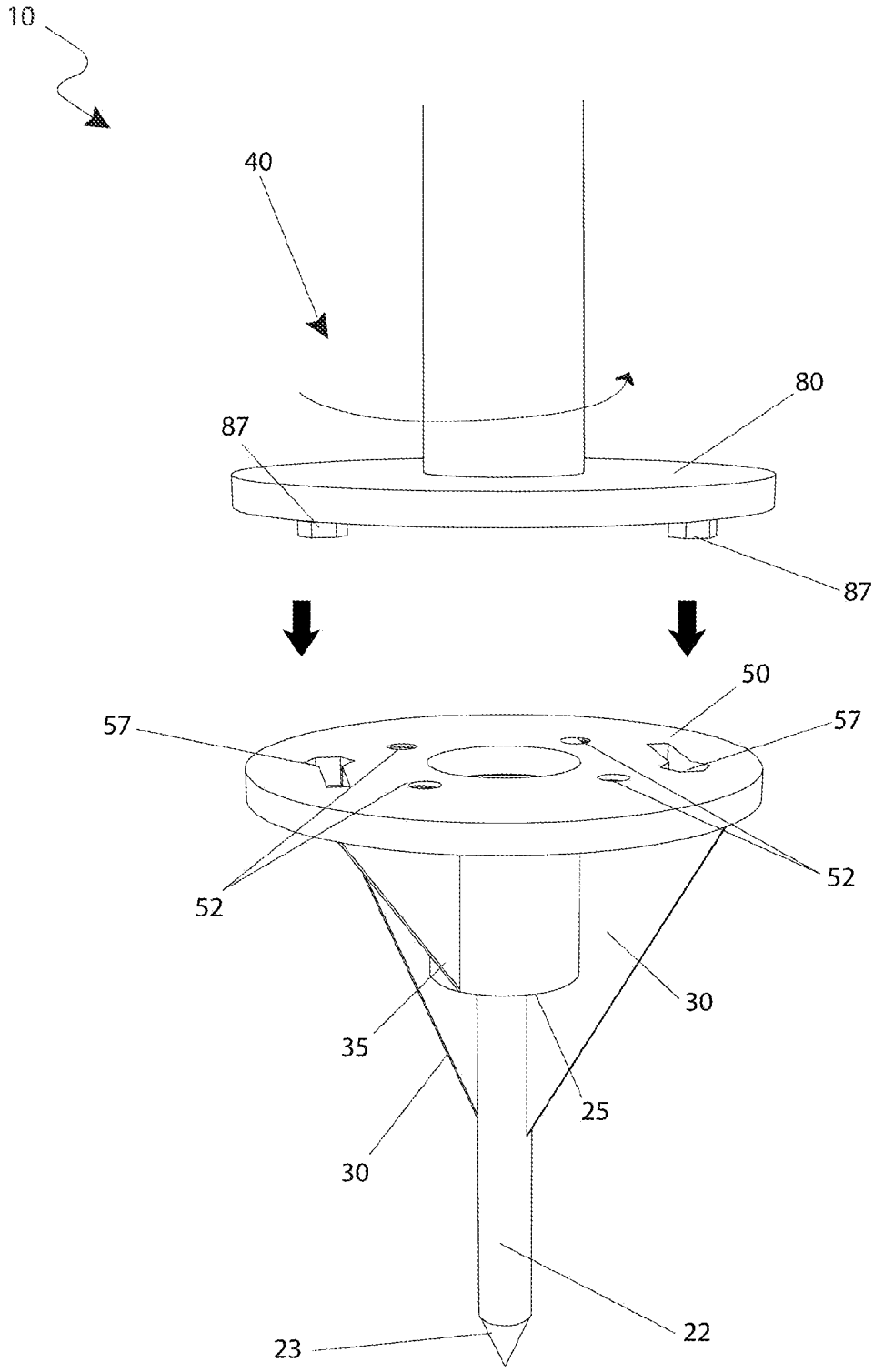
FIG. 7 is a perspective view of the driving device 40 installably released therefrom the anchor device 20 showing the motions of installment needed, according to the preferred embodiment of the present invention; and, FIG. 8 is a front view of the fence post installation and anchoring system 10 with the motions of the hammer device 60 being illustrated, according to the preferred embodiment of the present invention.

Referring now to FIG. 7, a perspective view of the driving device 40 installably released therefrom the anchor device 20 showing the motions of installment needed is disclosed, according to the preferred embodiment of the present invention. The driving device 40 takes the form of a long cylinder containing two (2) contact arms 45 which is positioned relatively in the middle in terms of length of said driving device 40. Integrally disposed on the bottom side of the driving device 40 is a contact member 80 that is shaped similarly, if not the same, as the post receiving bracket 50. The contact member 80 is envisioned to take the form of a cylinder with an adequate diameter and thickness to accommodate in direct correspondence the size and shape of the post receiving bracket 50. The contact member 80 is envisioned to be integral with the driving device 40 that is situated directly above said driving device 40 with a centerline substantially aligned or parallel therewith the centerline of said contact member 80. Integrally disposed on the bottom surface of the contact member 80 are two (2) "T"-shaped pins 87 strategically designed to cooperate with the receiving apertures 57 integrally disposed thereon the post receiving bracket 50. The "T"-shaped pins 87 are inserted therein the larger portion of the receiving apertures 57, and then the driving device 40 is rotated radially until said pins 87 are slid into the smaller portion of the apertures 57 thereby releasably locking said "T"-shaped pins 87. The "T"-shaped pins 87 are disposed relatively mirrored along the lateral axis of the contact member 80 and oriented symmetrically.

Figure 8:
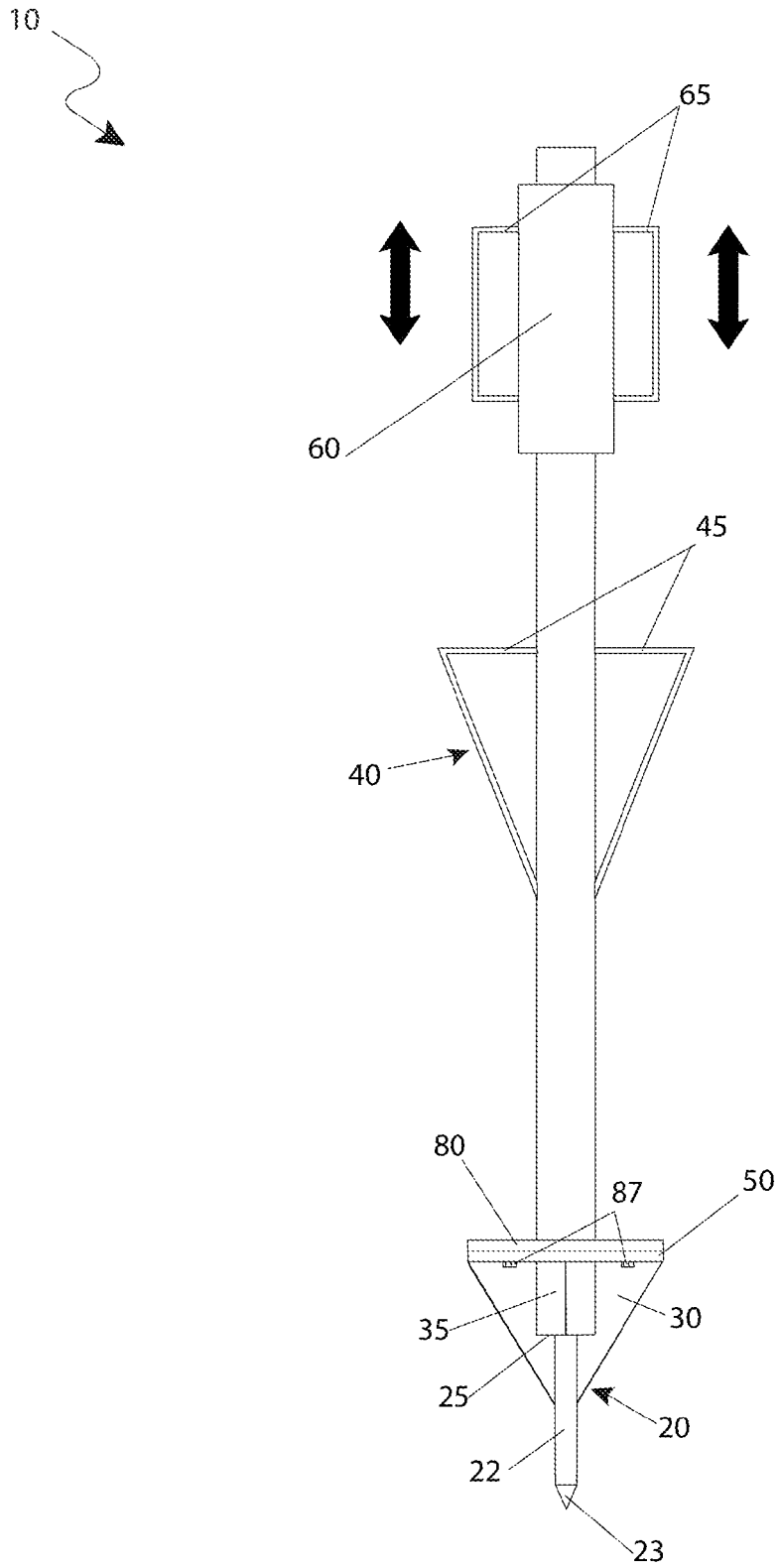

Referring now to FIG. 8, a front view of the system 10 with the motions of a hammer device 60 being illustrated is disclosed, according to the preferred embodiment of the present invention. The two (2) contact arms 45 are mirrored along the longitudinal centerline of the driving device 40 to provide a contact surface for the hammer device 60 to come into contact. The hammer device 60 is envisioned to take the shape of a heavy metallic cylindrical tube with two (2) handles 65 spanning outwardly therefrom. The hammer device 60 is envisioned to be of cylindrical design with a hollow center with a thickness that would allow said hammer device 60 to be lightweight and yet effective. The driving device 40 is envisioned to be of cylindrical design with a diameter that is sized proportionally smaller than the cross-sectional shape of the inside walls of the hammer device 60 such to enable said driving device 40 to be slidably received therewithin said hammer device 60. The driving device 40 may be temporarily, or alternatively permanently, inserted therein the hammer device 60 so as to be interconnected. The driving device 40 is sized to correspondingly be inserted therewithin the hammer device 60 such that the inside walls of said hammer device 60 uniformly abuts against the outside walls of the driving device 40. The handles 65 integrally disposed onto the hammer device 60 may be gripped by the user to motion said hammer device 60 upwardly followed by quick motion of the hammer device 60 downwardly until the bottom side of said hammer device 60, which is designed to be thicker at the bottom to accommodate such forces, to come into contact with the contact arms 45 of the driving device 40. The continued downward forces created by the hammer device 60 unto the contact arms 45 transfers the forces from the driving device 40 to the contact member 80 to the post receiving bracket 50 to the cylindrical member 22. Such downward forces urge the anchor device 20 to be driven into the ground.

An alternate embodiment of the present invention may comprise adapters or the like that may be utilized in conjunction with the receiving tube 25 and/or the metallic barriers 70 such that posts of various diameters or outer perimeters might be utilized with the system 10.

The preferred embodiment of the present invention can be utilized by the common user in a simple and effortless manner with little or no training. After initial purchase or acquisition of the system 10, it would be configured as indicated in FIGS. 1 through 8.

The method of utilizing the system 10 may be achieved by performing the following steps: placing the contact member 80 of the driving device 40 thereon the top side surface of the post receiving bracket 50; slidably engaging the "T"-shaped pins 87 therein the receiving apertures 57 by placing said "T"-shaped pins 87 therein the larger portion of said apertures 57; rotating the driving device 40, and consequently the contact member 80, such that the "T"-shaped pins 87 releasably lock therein the receiving apertures 57; placing the cylindrical member 22, and consequently the driving device 40 installed thereon the anchor device 20, on the ground such that the pointed edge 23 of said cylindrical member 22 contacts the ground; placing the hammer device 60 onto the cylindrical section of the driving device 40; reciprocally motioning the hammer device 60 up and down, and with each downward motion, contacting the contact arms 45 thereby applying force to the driving device 40, and consequently the anchor device 20; driving the anchor device 20 into the ground via the hammer device 60; slidably disengaging the "T"-shaped pins 87 therefrom the receiving apertures 57 by rotating the driving device 40, and consequently the contact member 80, such that the "T"-shaped pins 87 lockably release therefrom the receiving apertures 57; threadingly engaging screws 53 or other fasteners therethrough "L" brackets 55 thereto the post receiving bracket 50 threaded bores 52; attaching the metallic barriers 70 via engaging said barriers 70 therewith the "L"-shaped brackets 55; and, inserting the cylindrical fence post therein the receiving tube 25, if cylindrical post is being utilized, or inserting the rectangular fence post therein the metallic barriers 70.

The system 10 incorporates a hand-driven anchor device 20 that incorporates a post receiving bracket 50 for the installment and anchoring of galvanized or steel pipe used with yard fences, gateposts, pet pens, and the like. The system 10 further comprises a means in which a rectangular wooded fence post could be accommodated via the metallic barriers 70. The post receiving bracket 50 is integrally attached thereto a cylindrical member 22 and the receiving tube 25 securely, especially with utilization of the multiple gussets 30, 35 that are triangularly shaped steel plates to provide support and strength. The post receiving bracket 50 is then driven into the ground such that the top surface is flush with the ground surface. After driving, the post receiving bracket 50 is ready for fence posts, gateposts, and other ground style devices. The installation means is accommodated via a driving device 40 that is releasably attached thereto the post receiver bracket 50 in combination with a hammer device 60. The post receiving bracket 50 is dimensionally sized to provide a large flat surface that is suitable for impact via the contact member 80, and spreads such impact over the entire anchor device 20, thus preventing damage. When the anchor device 20 is driven so that the post receiving bracket 50 is flush with the ground, the driving device 40 is simply removed and replaced with a permanent fence or gateposts.

A post may be mounted uprightly upon the surface of the ground by means of the system 10. The edge 23 of the cylindrical member 22 is first forced into the ground with the post receiving bracket 50 oriented uprightly so as to provide a means for the driving device 40 to be readily locked and released upon user discretion. The driving device 40 is then installed and operated which causes the anchor device 20 to be driven downward via the use of the hammer device 60. With some reciprocating downward motion applied by the hammer device 60 onto the contact arms 45, the driving device 40 applies force unto the post receiving bracket 50 which in turn transfers into the cylindrical member 22 to force the anchor device 20 into the ground. This action is continued until the anchor device 20 has been driven into the ground.

The driving device 40 is easily installed and removed unto the anchor device 20 via a "T"-shaped pins 87 removably inserted therein receiving apertures 57. The "T"-shaped pins 87 are inserted into the larger portion of the receiving apertures 57 and then the driving device 40 is rotated to lock said "T"-shaped pins 87 thereby engaging the driving device 40 unto the anchor device 20. The hammer device 60 may then be utilized to drive the anchor device 20 into the ground. Two (2) gripping handles 65 are positioned on the hammer device 60 and utilized for the user to manually grasp and motion said hammer device 60 to apply reciprocated blows to the contact arms 45 which drives the driving device 40 downwardly. The hammer device 60 is slideably connected to the cylindrical portion of the driving device 40 for sliding reciprocating movement along the length of the cylindrical portion with the gripping handles 65 providing means for the manual motion apply reciprocating blows to the contact arms 45 of the driving device 40; the forces applied by the hammer device 60 is being transferred directly through the drive member 40 to the contact member 80 so that the contact member 80 drives the anchor device 20 downwardly into the ground.

The anchor device 20 is driven into a flush engagement with the surface of the ground and then the driving device 40 is uncoupled and removed from the post receiving bracket 50 leaving the anchor device 20 firmly embedded in the ground with its receiving tube 25 remaining easily accessible for cylindrical posts, or alternatively, metallic barriers 70 may be installed for rectangularly shaped posts. In either case, the receiving tube 25 and the metallic barriers 70 provides a high degree of stability for the posts. The post is inserted either into the receiving tube 25 or between the metallic barriers 70 and brought to rest upon the bottom surface of said receiving tube 25 or the top surface of the post receiving bracket 50 thereby becoming mounted uprightly and secured upon the anchor device 20 that is within the ground. The posts are envisioned to be frictionally received within the receiving tube 25 or the metallic barriers 70 and held in place via friction, adhesive, fasteners, and/or other fastening methods.

The post receiving bracket 50 may also be used to support square shaped rather than cylindrically shaped posts by the use of the metallic barriers 70. These metallic barriers 70 are optionally installed via the use of "L" brackets 55 that are installed via the threaded bores 52 integrally disposed on the post receiving bracket 50. In use, the metallic barriers 70 are installed upon the post receiving bracket 50 just after driving the anchor device 20 into the ground.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A fence post installation system comprises:

a bracket, further comprising:

a bracket body;

a cylindrical receiving tube centrally located on said bracket body, comprising a downwardly depending cylindrical body having a side wall and a bottom wall and an open upper end coextensive with an upper surface of said bracket body; and, a pair of small gussets each affixed to opposing surfaces of said side wall of said receiving tube at a first end and to a bottom surface of said bracket body at a second end;

a driving device removably installed on said bracket for providing a driving means for driving said bracket; and, an installation means for installing a fence post within said bracket;

wherein said bracket engages a ground surface when acted upon by said driving device;

wherein said receiving tube accommodates said fence post having a circular cross-section:

wherein said pair of small gussets provide a supporting means for said receiving tube to said bracket body; and, wherein said system comprises a weather-proof material of construction.

2. The system of claim 1, wherein said bracket further comprises an anchoring device further comprising:

an anchoring body depending downward from said receiving tube; and, a pair of large gussets each affixed to opposing surfaces of a side wall of said receiving tube at a first end and to a bottom surface of said bracket body at a second end;

wherein said pair of small gussets provide a supporting means for said receiving tube to said bracket body; and, wherein said anchoring device provides a supporting means for said system and said fence post supported within said bracket.

3. The system of claim 2, wherein said anchor device further comprises a cylindrical member that converges into a substantially pointed distal end.

4. The system of claim 1, wherein said driving device further comprises:

an elongated driving body having an upper end and a lower end;

a contact member affixed to said lower end; and, a pair of contact arms intermediately positioned at diametrically opposing side surfaces of said elongated driving body.

5. The system of claim 1, wherein said installation means further comprises a plurality of receiving apertures located on said bracket body for correspondingly receiving a plurality of pins located on a bottom surface of said driving device;

wherein each pin is inserted into each aperture and manipulated to secure within, thereby removably securing said driving device to said bracket body.

6. The system of claim 1, further comprising a plurality of barriers removably attached to an upper surface of said bracket body, each of said plurality of barriers further comprises a resilient plate;

wherein said plurality of barriers are arranged to provide a receiving means to accommodate said fence post having a rectangular cross-section.

7. A fence post installation system comprises:

a bracket, further comprising:

a bracket body;

a cylindrical receiving tube centrally located on said bracket body, comprising a downwardly depending cylindrical body having a side wall and a bottom wall and an open upper end coextensive with an upper surface of said bracket body; and, a pair of small gussets each affixed to opposing surfaces of said side wall of said receiving tube at a first end and to a bottom surface of said bracket body at a second end;

a driving device removably installed on said bracket for providing a driving means for driving said bracket;

a hammer device removably positioned on said driving device; and, an installation means for installing a fence post within said bracket;

wherein said hammer device delivers a driving force to said driving device;

wherein said receiving tube accommodates said fence post having a circular cross-section:

wherein said pair of small gussets provide a supporting means for said receiving tube to said bracket body;

wherein said bracket engages a ground surface when acted upon by said driving device; and, wherein said system comprises a weather-proof material of construction.

8. The system of claim 7, wherein said bracket further comprises an anchoring device further comprising:

an anchoring body depending downward from said receiving tube; and, a pair of large gussets each affixed to opposing surfaces of a side wall of said receiving tube at a first end and to a bottom surface of said bracket body at a second end;

wherein said pair of small gussets provide a supporting means for said receiving tube to said bracket body; and, wherein said anchoring device provides a supporting means for said system and said fence post supported within said bracket.

9. The system of claim 8, wherein said anchor device further comprises a cylindrical member that converges into a substantially pointed distal end.

10. The system of claim 7, wherein said driving device further comprises:

an elongated driving body having an upper end and a lower end;

a contact member affixed to said lower end; and, a pair of driving contact arms intermediately positioned at diametrically opposing side surfaces of said elongated cylindrical body.

11. The system of claim 7, wherein said installation means further comprises a plurality of receiving apertures located on said bracket body for correspondingly receiving a plurality of pins located on a bottom surface of said driving device;

wherein each pin is inserted into each aperture and manipulated to secure within, thereby removably securing said driving device to said bracket body.

12. The system of claim 7, further comprising a plurality of barriers removably attached to an upper surface of said bracket body, each of said plurality of barriers further comprises a resilient plate;

wherein said plurality of barriers are arranged to provide a receiving means to accommodate said fence post having a rectangular cross-section.

13. The system of claim 7, wherein said hammer device further comprises:

a weighted hammer body comprising a hollow center portion, an upper portion, and a lower portion comprising a thickness larger than said upper portion; and, a pair of handles intermediately positioned at diametrically opposing side surfaces of said hammer body and spanning outwardly;

wherein said hammer device is slidingly placed on an upper end of said driving device; and, wherein said hammer device downwardly travels on said driving device until contacting said pair of contact arms of said driving device to provide a contact surface for said hammer device to deliver said driving force.

14. A method for installing a fence post bracket in a ground surface comprises the following steps:

providing a bracket body, further comprising:

a cylindrical receiving tube centrally located on said bracket body, comprising a downwardly depending cylindrical body having a side wall and a bottom wall and an open upper end coextensive with an upper surface of said bracket body;

a pair of small gussets each affixed to opposing surfaces of said side wall of said receiving tube at a first end and to a bottom surface of said bracket body at a second end;

an anchoring body depending downward from said receiving tube, comprising a cylindrical member that converges into a substantially pointed distal end; and, a pair of large gussets each affixed to opposing surfaces of a side wall of said receiving tube at a first end and to a bottom surface of said bracket body at a second end;

positioning said anchoring body of said bracket body against a desired location on said ground surface;

providing a driving device, further comprising an elongated driving body having an upper end and a lower end, a contact member affixed to said lower end, and a pair of contact arms intermediately positioned at diametrically opposing side surfaces of said elongated driving body;

installing said driving device onto said bracket body with an installation means;

providing a hammer device, further comprising a weighted hammer body having a hollow center portion, an upper portion, and a lower portion comprising a thickness larger than said upper portion, and a pair of handles intermediately positioned at diametrically opposing side surfaces of said hammer body and spanning outwardly;

slidingly engaging said hammer device onto said upper end of said driving device;

forcibly contacting said hammer device onto said pair of contact arms, thereby providing a driving force to said driving device, wherein said driving device drives said anchoring means into said ground surface;

removing said hammer device from said driving device; and, removing said driving device from said bracket body.

15. The method of claim 14, further comprising the step of installing said fence post having a circular cross-section into said receiving tube.

16. The method of claim 14, further comprising the steps of:

providing a plurality of barriers;

installing and arranging said plurality of barriers to said upper surface of said bracket to produce an auxiliary receiving tube to accommodate said fence post comprising a rectangular cross-section; and, installing said fence post having a rectangular cross-section into said auxiliary receiving tube.

* * * * *